United States Patent [19]

Hildebrandt

[11] 4,150,484

[45] Apr. 24, 1979

[54] SHEARS WITH IMPROVED CUTTING ACTION AND METHOD OF MAKING SAME

[75] Inventor: William J. Hildebrandt, West Simsbury, Conn.

[73] Assignee: The Stanley Works, New Britain, Conn.

[21] Appl. No.: 847,697

[22] Filed: Nov. 2, 1977

[51] Int. Cl.[2] ..... B26B 13/06; B21K 11/06

[52] U.S. Cl. ..... 30/254; 76/104 A

[58] Field of Search ..... 30/254, 260, 261, 262, 30/341, 266; 76/104 A

[56] References Cited

U.S. PATENT DOCUMENTS

| | | | |
|---|---|---|---|
| 523,950 | 7/1894 | Thompson | 30/266 |
| 915,697 | 3/1909 | Polley | 30/259 |
| 3,869,793 | 3/1975 | Ferguson | 30/262 |

FOREIGN PATENT DOCUMENTS

| | | | |
|---|---|---|---|
| 394556 | 11/1908 | France | 30/262 |
| 1404 of | 1886 | United Kingdom | 30/254 |
| 1441988 | 7/1976 | United Kingdom | 30/254 |

*Primary Examiner*—Jimmy C. Peters

[57] ABSTRACT

A shears includes a pair of blade portions with opposed convexly curvilinear cutting edges extending longitudinally thereof assembled for pivotal movement between closed and open positions. The curves defined by the cutting edges are mirror images and, in the open position, intersect at a point spaced from the pivot means towards the outer end of the cutting edges. The cutting angle defined by tangents to the curves at the points of intersection over substantially the entire length of the cutting edges during closing movement is substantially constant and within the range of 12–30°. The preferred shears have a rake angle of 4–14° and have blade portions which are inclined towards each other to provide wiping action at the point of intersection along substantially the entire length of the cutting edges.

9 Claims, 20 Drawing Figures

SHEARS WITH IMPROVED CUTTING ACTION AND METHOD OF MAKING SAME

BACKGROUND OF THE INVENTION

For many years, various configurations for shears have been devised and proposed in an effort to provide effective cutting action on a variety of materials and over a range of thickness. It has been known that, when the cutting angle between the blades is too great, there is a tendency for the object being cut to be pushed outwardly along the blades rather than being cut. In some instances, serrated edges have been employed to minimize this squirting tendency.

Moreover, it has been known that providing a rake angle for the cutting edge will improve cutting efficiency and it has also been known that a biasing action at the point of intersection of the cutting edges of the blades will also improve cutting action.

Efforts have been made to provide a level of uniformity in the cutting angle along the length of the blade, as for example, in Shoffner U.S. Pat. No. 2,680,294 granted June 8, 1954. Efforts have also been made to provide some uniformity in the wiping action of the blade edges relative to each other as, for example, in Usborne U.S. Pat. No. 3,376,641 granted Apr. 9, 1968. Recently, there has been considerable activity in the fabrication of utility snips by stamping blade members from sheet metal with various elements of the desired configuration as, for example, those shown in Hough U.S. Pat. No. 3,974,564 granted Aug. 17, 1976; Koblick U.S. Pat. No. Des. 238,650 granted Feb. 3, 1976; and Stevenson U.S. Pat. No. Des. 239,080 granted Mar. 9, 1976.

It is an object of the present invention to provide novel and highly effective shears wherein the cutting angle defined between the cutting edges is substantially constant throughout the effective cutting length of the blade.

It is also an object to provide such shears wherein the cutting action provided by the substantially uniform cutting angle is augmented by blade edges with a desirable rake angle and which are biased together over substantially either entire length to provide the desired wiping action at the point of cutting.

Another object is to provide such shears which may be readily and economically fabricated from sheet metal to provide a durable and versatile tool.

Still another object is to provide a method for manufacturing such shears conveniently and economically.

SUMMARY OF THE INVENTION

It has now been found that the foregoing and related advantages may be readily attained in a shears comprising a pair of operating members each having a blade portion at one end, a handle portion at the other end, and an intermediate pivot portion. The blade portions have opposed convexly curvilinear cutting edges extending longitudinally thereof. Pivot means pivotably secure the pivot portions of the operating members together for relative pivotal movement between a closed position wherein the cutting edge of each blade portion overlies the side surface of the blade portion of the other operating member and an open position wherein the cutting edges are spaced apart. The curves defined by the cutting edges are mirror images and, in the open position of the shears, intersect at a point spaced from the pivot means towards the outer end of the cutting edges. The cutting angle defined by tangents to the curves of the curvilinear cutting edges at the points of intersection along substantially the entire length thereof during closing movement of the shears is substantially constant and within the range of 12–30°.

In the preferred structures, the cutting edges have a rake angle of 4–14° and most desirably 5–10°; the cutting angle is desirably within the range of 14–22°. To provide wiping action at the point of intersection along substantially the entire length of the cutting edges, the blade portions of the operating members are inclined towards each other.

Most conveniently, the operating members include sheet metal blade members providing the blade portion, pivot portion and a part of the handle portion, and the blade members are inclined towards each other to provide the desired wiping action at the point of intersection. The blade members also include opposed boss portions about the pivot means to provide the bearing surfaces thereabout.

In the method of making the shears, a pair of blade members is formed so that each has a blade portion at one end, a handle portion at the other end and a pivot portion therebetween with a pivot aperture extending through the pivot portion. A curvilinear cutting edge is provided along one endge of the blade portion, with the curves of the cutting edges being substantially identical and corresponding to the formula set forth hereinafter. The blade members are assembled with their cutting edges opposed and with a pivot member extending through the pivot apertures to provide for relative pivotal movement between a closed position wherein the cutting edge of each blade portion overlies the side surface of the blade portion of the other blade member and an open position wherein the cutting edges are spaced apart. The cutting edges have a curve corresponding to the following formula $$x = \frac{1}{\sqrt{\frac{y^2}{x^2} + 1}} \epsilon \left( \frac{1}{\tan \frac{\theta_c}{2}} \times \tan^{-1} \frac{y}{x} \right) + \log_\epsilon x_1$$

wherein $\theta$ = the cutting angle defined by the tangents to the curvilinear cutting edges at the point of intersection thereof;

x = the distance in inches from the center of the pivot aperture along the imaginary line bisecting the cutting angle ($\theta$);

y = the distance in inches to the cutting edge along an imaginary line perpendicular to imaginary line for x;

$x_1$ = the distance in inches along the imaginary line for x to the point of initial intersection of the blade edges in the open position;

and wherein x is within the range of 0.3–2.0;

$\theta$ is within the range of 12–30°; and $\epsilon$ is 2.71828

Most conveniently, the blade members are formed by stamping sheet metal, and the cutting edges are ground to provide a rake angle of 4–14°. The stamped blade members are formed with their blade portions angularly disposed relative to the pivot and handle portions thereof with the blade portions being inclined oppositely of each other as assembled so as to produce the desired wiping action at the point of intersection.

DETAILED DESCRIPTION OF THE ILLUSTRATED EMBODIMENT

Figure 1:
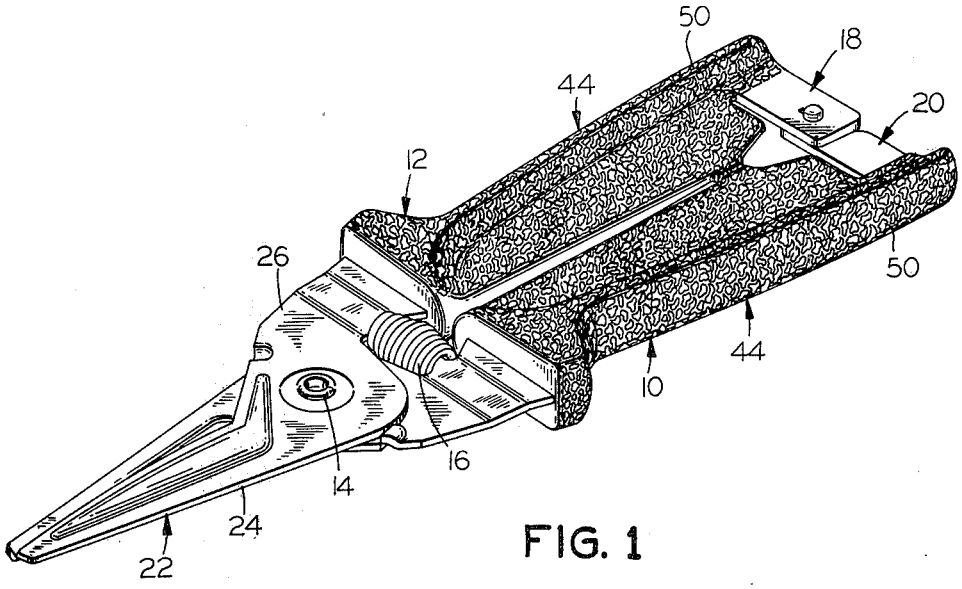
FIG. 1 is a perspective view of shears embodying the improved cutting blade configuration.

Turning now in detail to the attached drawings, shears or snips embodying the present invention are illustrated in FIGS. 1–7 and are comprised of the operating members generally indicated by the numerals 10,12 which are pivotable relative to each other about the pivot pin or rivet 14. The compression spring 16 normally biases the operating members apart into the position shown in FIG. 7 and the operating members 10,12 may be secured in the closed position of FIGS. 1–3 by means of a latch assembly including the latch member on the operating member 12 generally designated by the numeral 18 and the latch post member on the operating member 10 generally designated by the numeral 20.

Figure 8:
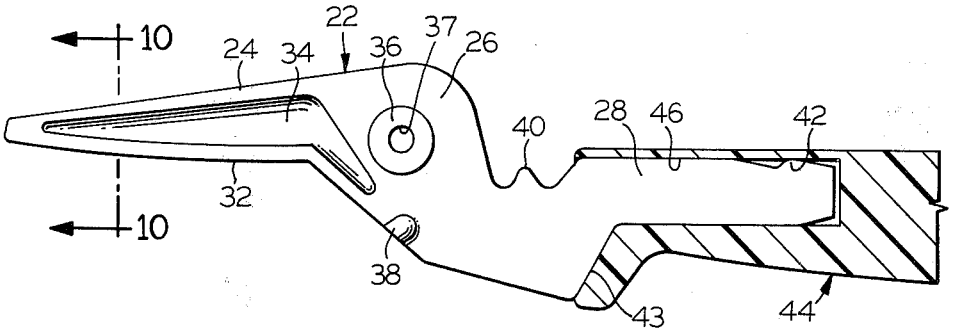
FIG. 8 is a fragmentary plan view of one of the operating members with a portion of the handle in section to reveal internal construction.

In FIG. 8 there is illustrated one of the operating members 10,12 since the two members are identical with the exception of the latch members 18,20. Each operating member 10,12 is comprised of a sheet metal blade member generally designated by the numeral 22 and a synthetic resin handle member generally designated by the numeral 44.

Turning first in detail to the construction of the blade member 22, it is conveniently stamped from sheet metal so as to provide at one end a blade portion 24 tapering to a reduced width at its outer end, an intermediate pivot portion 26, and a handle portion or tang 28 extending from the pivot portion 26 to the side of the pivot aperture 37 therein opposite from the blade portion 24. The blade portion 24 is provided with an arcuate cutting edge 32 and a reinforcing rib or boss 34 of generally L-shaped configuration is formed in the metal somewhat inwardly from the cutting edge 32 and the adjacent edge surface of the pivot portion 26. In the assembled structure, the bosses 34 of the cooperating blade members 22 project oppositely from each other so as not to interfere with the cutting action of the blade portions 24.

A circular boss 36 is provided about the pivot aperture 37 and extends in the opposite direction from the reinforcing boss 34 so that, in the assembled structure, the raised bosses 36 of the two cooperating blade members 22 will function as the bearing surfaces therefor. In addition, the pivot portion 26 is provided with a stop boss 38 along the same side as the cutting edge 32 and which limits pivotal movement of the other operating member 10,12 to the blade open position in response to the biasing action of the spring 16. The stop boss 38 projects in the same direction as the reinforcing boss 34, and the outer edge of the other operating member 10,12 will abut the edge of the upstanding stop boss 38.

Along the edge of the handle portion on the opposite side from the blade cutting edge 32, there is provided a spring guide projection 40 adjacent the pivot portion 26 and a recess adjacent the end thereof providing a locking shoulder 42 for a purpose to be described more fully hereinafter. This edge of the handle portion 28 extends substantially in alignment with the cutting edge 32, and the configuration of the handle portion 28 is such that the opposite edge thereof initially extends to a substantial spacing from the first mentioned edge and then tapers inwardly to provide an abutment shoulder 43 and a terminal handle portion of substantially lesser width.

Figure 2:
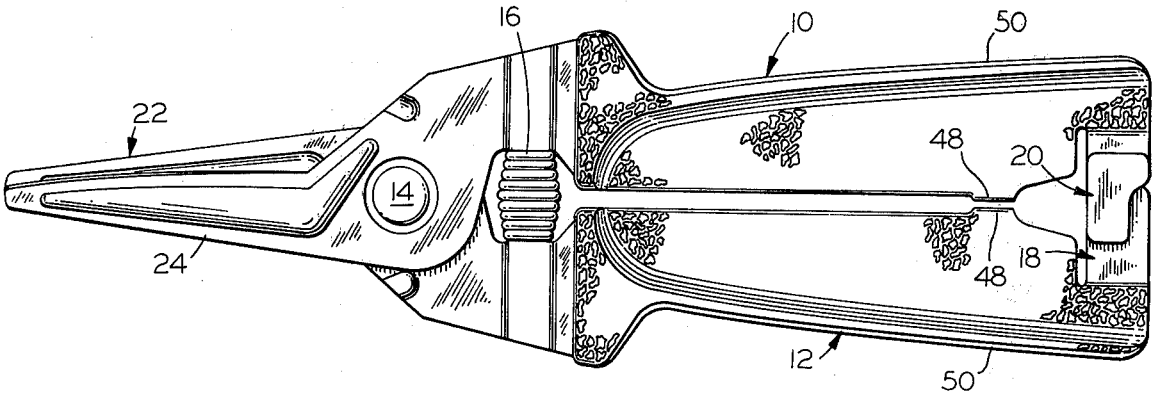
FIG. 2 is a top plan view thereof.
Figure 3:
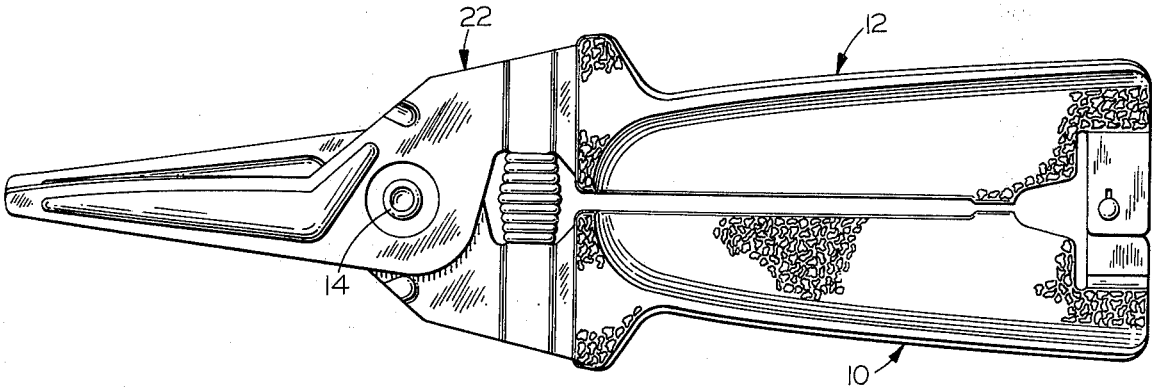
FIG. 3 is a bottom view thereof.
Figure 4:
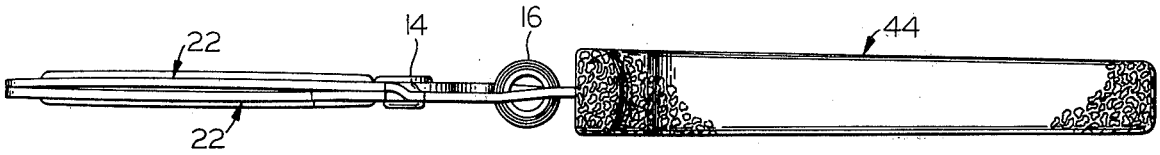
FIG. 4 is a side elevational view thereof.
Figure 5:
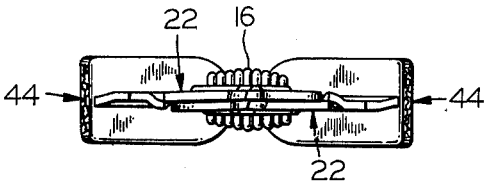
FIG. 5 is an end elevational view of the blade end thereof.
Figure 6:
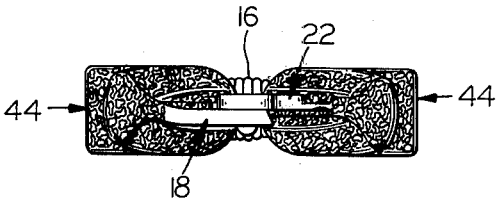
FIG. 6 is an end elevational view of the handle end thereof.
Figure 7:
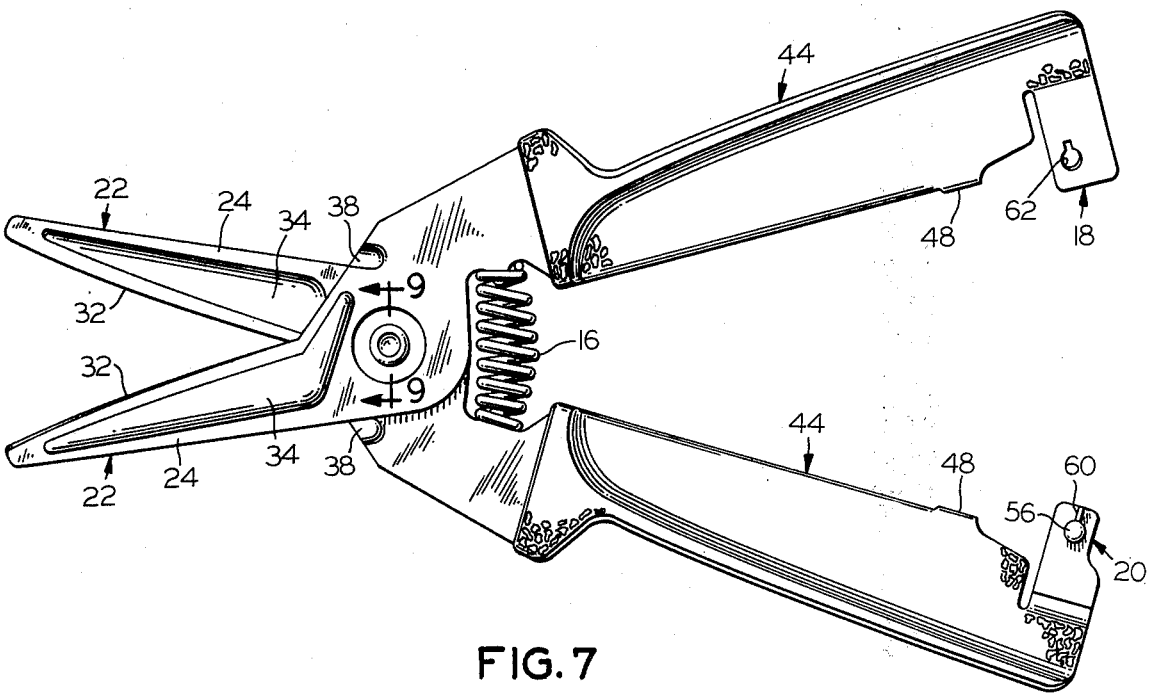
FIG. 7 is a plan view with the blades and handles in the biased open position.

The synthetic resin handles 44 are of generally L-shaped configuration and have cavities 46 therein of generally rectangular cross section to seat the handle portions 28 of the blade members 22. As seen in FIG. 8, the cavities 46 have an outwardly tapering portion adjacent the opening therein to provide a surface abutting the abutment shoulder 43 of the blade member 22 when the blade members 22 are driven into the cavities 46. Moreover, locking shoulder 42 on the handle portion 28 of the blade members 22 will tend to embed itself in the syntheteic resin of the handle 44 so as to prevent disengagement after assembly. As seen in FIGS. 1–3, the handles 44 are of greater thickness along their outer side margins to provide ribs 50 of increased surface area for gripping by the hand of the user. On the adjacent edges of the handles 44 are laterally projecting and aligned projections or stops 48 which limit closing movement thereof.

One of the handles 44 is formed to provide the latch post member 20 which is best seen in FIGS. 6, 7, 12 and 13. The latch post member 20 extends laterally from the outer end of the handle 44 perpendicularly to the longitudinal axis of the handle 44 and includes at its free end a relatively thick body portion 52 connected to the body of the handle 44 by a reduced thickness hinge portion 54. Projecting upwardly from the body portion 52 is the latch post generally comprised of the cylindrical post portion 56 and the buttress portion 60 which is inclined from adjacent the upper end of the cylindrical post portion 56 to the free edge of the body portion 52. The cylindrical portion 56 is undercut on its surface opposite the buttress 60 to provide a shoulder 58.

Figure 13:
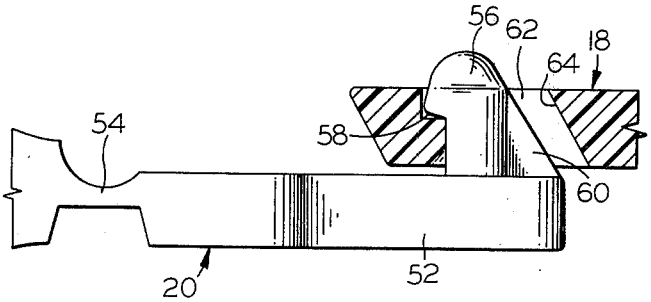
FIG. 13 is a fragmentary sectional view to the same scale showing the handles as latched.

The other handle 44 is configured to provide the latch member 18 which comprises a lateral arm extending perpendicularly to the longitudinal axis of the handle to overlie the body portion 52 of the latch post member 20 and having a keyhole shaped aperture 62 adjacent its free end. The linear portion of the aperture 62 is dimensioned and configured to cooperate with the butress portion 60 of the latch post and has a cooperatively tapering surface 64. The circular portion of the aperture 62 opposite the linear portion has an enlarged portion adjacent the outer surface to provide a shoulder 66 which cooperates with the shoulder 58 on the cylindrical post 56 for effecting latching action as seen in FIG. 13.

Figure 10:
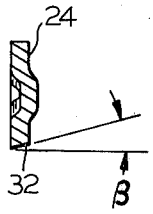
FIG. 10 is a sectional view to an enlarged scale along the line 10—10 of FIG. 8.
Figure 11:
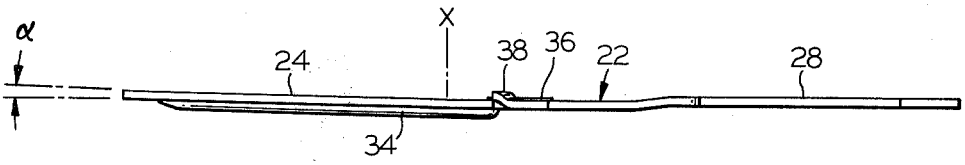
FIG. 11 is a side elevational view to an enlarged scale of one of the blade members with construction lines included to indicate the angular disposition of the blade portion.
Figure 12:
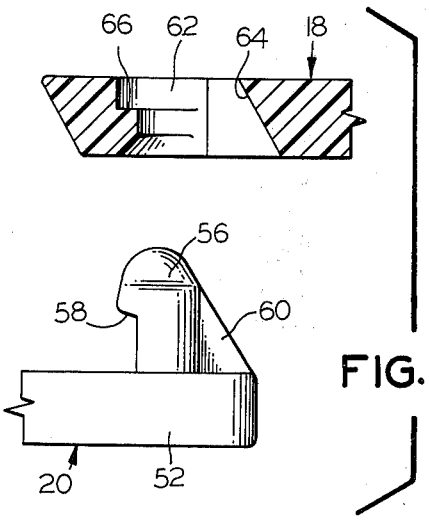
FIG. 12 is a fragmentary exploded view to a greatly enlarged scale of the latch portion of the handles.

As seen in FIG. 10, the cutting edge 32 is ground so as to provide a rake angle beta which is highly desirable to provide clearance to facilitate cutting by the edge 32 through various materials. As seen in FIG. 11, the tendency for the relatively flexible blade portion 24 to deflect apart during cutting action is compensated by inclining the blade portions 24 from the plane of the pivot portion 26 and handle portion 28 in the direction of the cooperating blade member 22. The angle of incline from the point X representing the inner end of the cutting edge 32 to the outer end of the blade portion 24 is represented by the angle alpha. Since the two blade portions 24 are inclined towards each other, there is a constant biasing pressure operating at the point of contact of the cutting edges 32 which ensures the desired wiping action of the blade portions adjacent the point of cutting.

Figure 14:
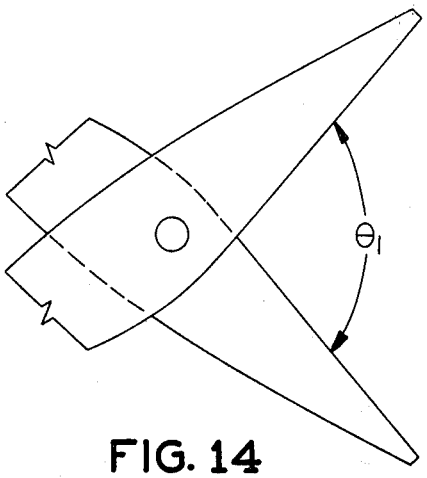
FIG. 14 is a fragmentary diagrammatic illustration of a prior art type of shears using a linear cutting edge and indicating the cutting angle when the blades are in the fully opened position.
Figure 15:
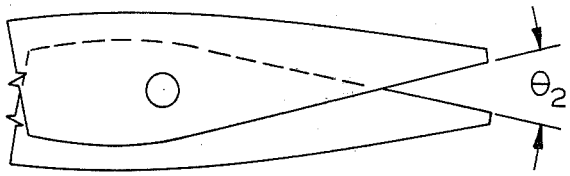
FIG. 15 is a similar diagrammatic view of the same shears with the blades approaching the end of the closing movement thereof.

The configuration of the cutting edge 32 is critical to achieving the desired cutting action over substantially the entire length thereof. In FIG. 14 and FIG. 15 are illustrated shears having a rectilinear cutting edge between which is defined a cutting angle theta. In the blade full open position of FIG. 14, the cutting angle theta is quite large which will tend to push the material to be cut outwardly (the squirting effect). In FIG. 15, the cutting angle theta is much smaller so that there will be little tendency to push the material out. Thus, the cutting angle theta will vary from very large to very small as the point of intersection of the blade edges moves outwardly from the pivot.

Figure 16:
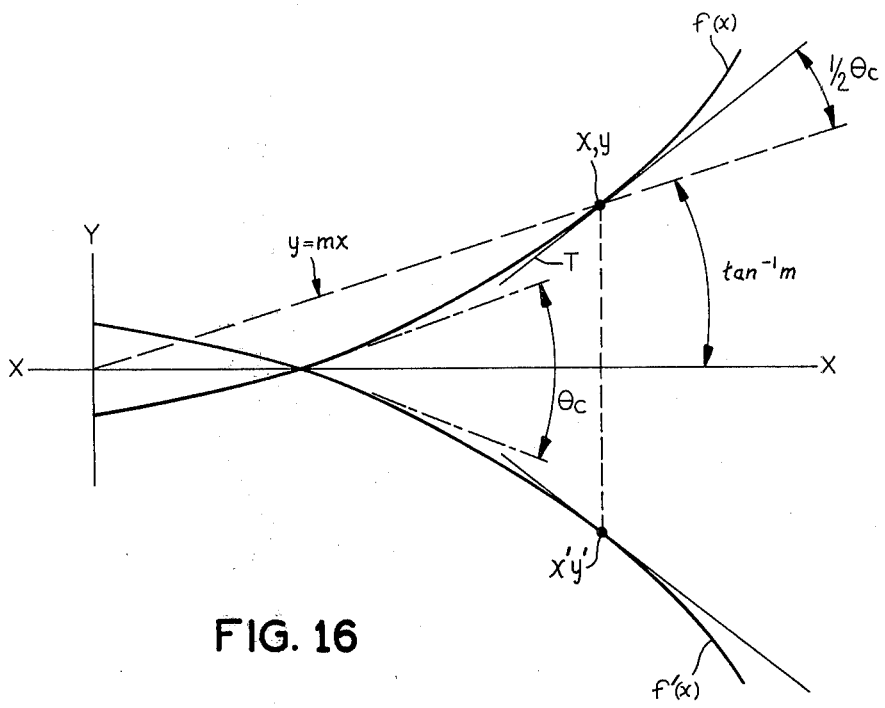
FIG. 16 is a fragmentary diagrammatic view of shears embodying arcuate cutting edges with reference designations of various constructional features required for proper design thereof.

In FIG. 16, there are diagrammatically represented two cutting blade edges f(x) and f'(x) having a pivot point defined by the intersection of the X and Y grid lines. The cutting angle $\theta_c$ is defined by the tangents to the point of intersection of the curved edges and it is desired to maintain this angle constant as the point of intersection of the cutting edges moves outwardly along the blade edges.

The point x,y is spaced further out along the blade edges from the point of intersection shown and the tangent at that point is shown by the line T. The line from the pivot to that point is defined as $$y = mx$$

and the angle of elevation of the line from the X grid is defined as $$\tan^{-1} m$$

If the curved edges were to be pivoted to bring the points x,y and x',y' onto the X grid line, the cutting angle would be $\theta$. Thus, the cutting angle between the construction line y=mx and the tangent thereto at any point along the curve is $\frac{1}{2}\theta$ or $\theta/2$.

Figure 17:
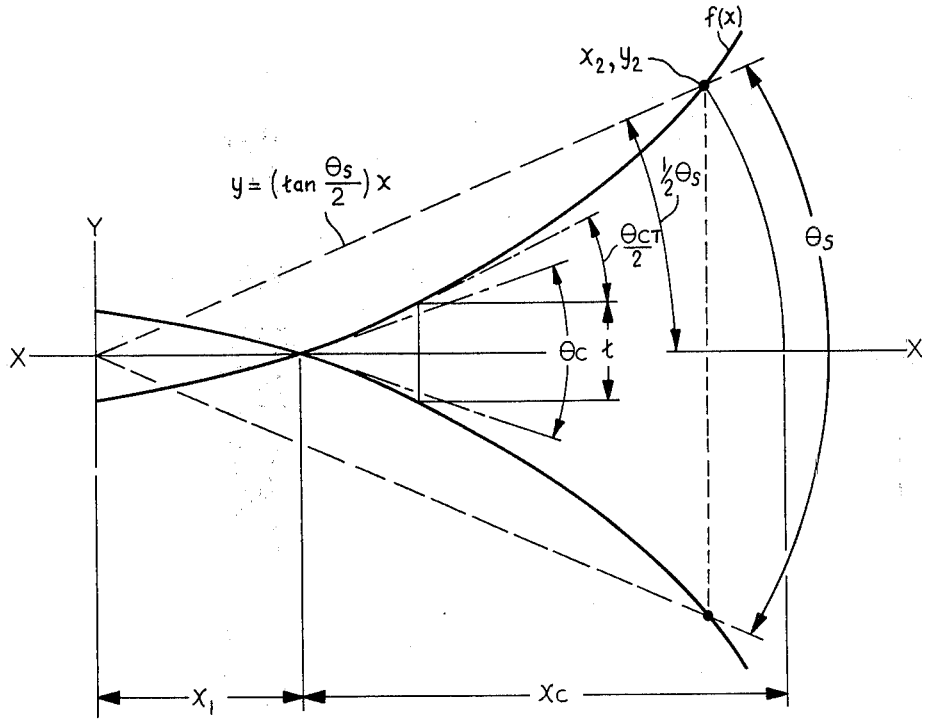
FIG. 17 is a similar view further showing the effect of the thickness of the material being cut upon the cutting action.

The slope of the blade curve at point (x,y), better known as the derivative of the curve, can then be expressed as:

$$dy/dx = \tan[\tfrac{1}{2}\theta_c + \tan^{-1}(y/x)]$$

where y/x is substituted for m. Solving this differential equation results in the blade curve as defined by the formula:

$$x = \frac{1}{\sqrt{\frac{y^2}{x^2} + 1}} \epsilon \left( \frac{1}{\tan \frac{\theta_c}{2}} \times \tan^{-1} \frac{y}{x} \right) + \log_\epsilon x_1$$

wherein $\theta_c$ = the cutting angle defined by the tangents to the curvilinear cutting edges at the point of intersection thereof;

x = the distance in inches from the center of the pivot aperture along the imaginary line bisecting the cutting angle ($\theta_c$);

y = the distance in inches to the cutting edge along an imaginary line perpendicular to imaginary line for x;

$x_1$ = the distance in inches along the imaginary line for x to the point of initial intersection of the blade edges in the open position;

Turning now to FIG. 17, the blade curves f(x) and f'(x) are similarly constructed with the initial point of intersection of the cutting edges in the open position being a distance $x_1$ from the pivot. Here can be seen the basis for the method of calculating the length of cut $x_c$ and the total angular stroke $\theta_s$ as well as the effect of the thickness of the material being cut t. The length of the blade to the tip is defined by the point $x_2, y_s$ and the angular cutting stroke $\theta_s$ is defined by the angle between the imaginary lines drawn from the pivot point to those points in the open position of the blades. Since y= (tan $\theta_s/2$)x and values of $\theta_s$ can be empiracally selected, it can be derived that $$X_c = \sqrt{X_2^2 + Y_2^2} - 1$$

Several calculations can be used to derive the optimum combination of values for $x_c$ and $\theta_s$.

As seen in FIG. 17, the thickness of the stock being cut t will define an angle between the tangent at the point of contact with the blade and a parallel line to the X grid of $\theta_{CT}/2$. It is important that $\theta_c$ be less than $\theta_{ct}$ for the bulk of the materials to be cut to get good cutting action.

Although the cutting angle theta may be greater than 30° for soft materials or when a large rake angle is employed, it has been found that a uniform cutting angle of 12–30° is desirable for most materials and the range of thicknesses that will normally be encountered. Preferably, this angle is in the range of 14–22°. Although the distance from the pivot to the initial point of intersection ($x_1$) may be larger, generally it will fall within the range of 0.3–2.0 inches and preferably 0.4–0.8 inch.

Figure 18:
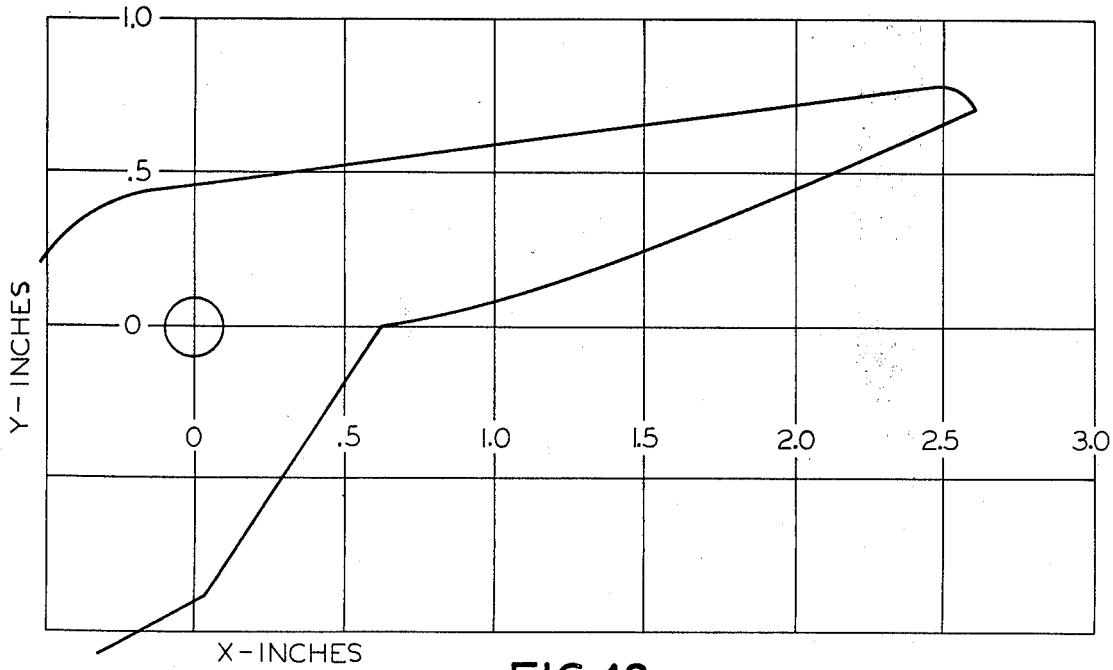
FIG. 18 is a graphic plot of the curve of a blade fabricated in accordance with the present invention.

In FIG. 18, there is graphically presented the preferred curve configuration for the shears of FIGS. 1–13, drawn to twice the scale and using for the equation the following values:

$x_1 = 0.6$ $\theta_c = 20°$

Figure 19:
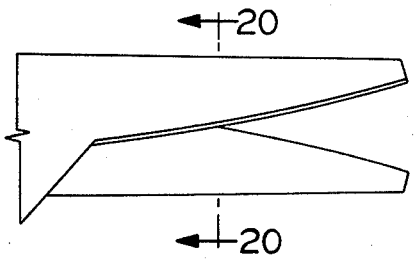
FIG. 19 is a diagrammatic view showing the rake angle of the arcuate blade.
Figure 20:
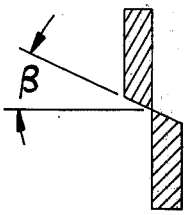
FIG. 20 is a diagrammatic view along the line 20—20 of FIG. 19.

To provide improved cutting action, the cutting edges are desirably hollow ground to provide the rake angle as shown in FIGS. 19 and 20. The rake angle may range from as little as 4° to 14° and even higher albeit with a tendency for more rapid wear or fragility. Preferably, the rake angle is within the range of 5–10°.

In operation of the shears, the latch post member 20 is disengaged from the latch member 18 by pressing the handles 44 towards each other which causes the sloping surface of the buttress portion 60 of the latch post to bear against the tapered surface 64 of the latch aperture 62 as operating members 10,12 are pivoted somewhat about the pivot 14. This produces a camming action causing the latch post to be cammed outwardly and downwardly relative to the latch aperture 62. Thus, when the clamping pressure on the handles 44 is released, the operating members 10, 12 will spring apart towards the open position shown in FIG. 7.

The material to be cut (not shown) is introduced into the space between the cutting edges 32, and the user then applies closing pressure to the handles 44 which concurrently brings the blade portions 24 towards each other. Because of the configuration of the cutting edges 32 and the wiping action produced by the angular offset of the blade portion 24, the material will be cut at the point of contact without any substantial tendency for the material to be pushed outwardly by the cutting action. Moreover, the rake angle of the cutting edge 32 will provide the clearance necessary for effective cutting action of substantially all materials. Upon completion of the cutting stroke, the user releases the clamping pressure upon the handles 44 and the blade portions 24 again spring into a position to effect the next cut.

When cutting has been completed and it is desired to latch the handles 44, they are moved towards each other until the stops 48 abut or substantially abut, at which point the latch post member 20 overrides the latch member 18. The user may then press downwardly upon the latch post member 20 while at the same time releasing some of the closing pressure, and this will cause pivoting of the post member 20 about the hinge portion 54 and entry of the cylindrical post 56 into the keyhole aperture 62. As the cylindrical post 56 moves downwardly into the aperture 62, the camming action produced by the tapered surface 64 of the aperture and the tapered surface of the buttress portion 60 causes the post 56 to move in the opposite direction until the shoulder 58 and shoulder 66 enter into latching engagement, at which point all closing pressure may be removed from the handles 44.

In fabricating and assembling the shears of the present invention, the blade members 22 are conveniently stamped and punched from sheet metal into the desired configuration, heat treated and then subjected to a grinding operation to provide the rake angle beta along the cutting edge 32. The handles 44 are molded into the desired configuration and affixed to the blade members 22 by inserting and driving the handle portions 28 thereof into the cavities 46 of the handles 44. As previously indicated, the locking shoulder 42 will tend to imbed itself in the synthetic resin of the handle 44 defining the wall of the cavity 46 to prevent subsequent disengagement. If so desired, adhesive engagement may also be provided by an adhesive coating, heat sealing or other means, or physical interlocking may be increased by providing recesses or apertures in the handle portion 28 into which synthetic resin from the handles 44 may be caused to flow. Moreover, an alternate method of assembly may involve the forming of the handles 44 from molten resin about the previously formed handle portions 28.

Figure 9:
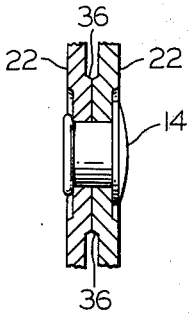
FIG. 9 is a fragmentary sectional view to an enlarged scale along the line 9—9 of FIG. 7.

Following assembly of the handles 44 to the blade members 32 to form the operating members 10,12, these members are then pivotably engaged by inserting the pivot pin or rivet 14 through the aligned apertures 37 and staking the shank thereof as seen in FIG. 9. The compression spring 16 is seated about the spring guide 40 of one of the handle portions 28, compressed, and then slipped over the spring guide 40 of the other handle portion 28. For shipping purposes, the latch post member 20 is engaged in the latch member 18 to complete the assembly as shown in FIGS. 1–6.

The synthetic resin employed for the handles should be one providing self-hinging properties such as polypropylene or ethylene/propylene polyallomers. The handles may be fabricated by injection molding, centrifugal molding, or any other suitable technique. The blade members are most desirably fabricated from stainless steel to permit their use for many cutting applications including foods and the like.

Although the hinged portion has been provided upon the pivot post member in the illustrated embodiment, it may be provided on the apertured latch member if so desired.

It may be appreciated that the overall configuration and dimensioning of the blade members may vary considerably from the illustrated in the drawings and that multiple corrugations or ribs may be employed to provide the desired stiffness in the sheet metal blade members.

Thus it can be seen from the foregoing detailed specification and attached drawings that the shears of the present invention is one in which the cutting angle defined between the cutting edges is substantially constant throughout the effective cutting length of the blade to afford highly effective cutting action. Moreover, the efficacy of the shears is augmented by blade edges having a desirable rake angle and which are biased together over substantially their entire length to provide the desired wiping action at the point of cutting. The shears may be readily and economically fabricated from sheet metal to provide a durable and versatile tool, and the method for fabricating the shears is one which is convenient and economical.

Having thus described the invention, I claim:

1. A shears comprising

A. a pair of operating members each including sheet metal members having a blade portion at one end, a handle portion at the other end, and an intermediate pivot portion, said blade portions having opposed convexly curvilinear cutting edges extending longitudinally thereof and elongated reinforcing bosses extending along and closely adjacent said cutting edges, said reinforcing bosses projecting oppositely from each other; and B. pivot means pivotably securing said pivot portions of said operating members together for relative pivotal movement thereof between a closed position wherein the cutting edge of each blade portion overlies the side surface of the blade portion of the other operating member and an open position wherein said cutting edges are spaced apart, the curves defined by said cutting edges being mirror images and, in said open position of said shears, intersecting at a point spaced from said pivot means towards the outer end of said cutting edges, the cutting angle defined by tangents to said curves of said curvilinear cutting edges at the points of intersection along substantially the entire length thereof during closing movement of said shears being substantially constant and within the range of 12–30°, said blade portions of said sheet metal members being inclined towards each other and relative to said pivot portion to provide wiping action at the point of intersection along substantially the entire length of said cutting edges.

2. The shears in accordance with claim 1 wherein said cutting edges have a rake angle of 4–14°.

3. The shears in accordance with claim 1 wherein said cutting angle defined by the curves of said cutting edges is within the range of 14–22° and wherein the rake angle provided by said cutting edges is 5–10°.

4. The shears in accordance with claim 1 wherein said blade members include opposed boss portions about said pivot means to provide the bearing surfaces at said pivot means.

5. The shears in accordance with claim 1 wherein the curves defining said cutting edges conform over substantially their entire length to the formula:

$$x = \frac{1}{\sqrt{\frac{y^2}{x^2} + 1}} \epsilon \left( \frac{1}{\tan \frac{\theta_c}{2}} \times \tan^{-1} \frac{y}{x} \right) + \log_\epsilon x_1$$

wherein $\theta_c$ = the cutting angle defined by the tangents to the curvilinear cutting edges at the point of intersection thereof;

x = the distance in inches from the center of the pivot aperture along the imaginary line bisecting the cutting angle ($\theta_c$);

y = the distance in inches to the cutting edge along an imaginary line perpendicular to imaginary line for x;

$x_1$ = the distance in inches along the imaginary line for x to the point of initial intersection of the blade edges in the open position and wherein $x_1$ is within the range of 0.3–2.0;

$\theta_c$ is within the range of 12–30°; and $\epsilon$ is 2.71828

6. The shears in accordance with claim 5 wherein the cutting angle is within the range of 14–22° and wherein said cutting edges have a rake angle of 4–14°.

7. In the method of making shears, the steps comprising:

A. forming a pair of sheet metal blade members to provide a blade portion at one end, a handle portion at the other end and a pivot portion therebetween with a pivot aperture therein;

B. providing along one edge of said blade portions a curvilinear cutting edge, the curves of said cutting edges being substantially identical and corresponding to the formula set forth hereinafter;

C. bending said blade portions of said blade members relative to said pivot portions thereof;

D. forming elongated reinforcing bosses in said blade members extending along and closely adjacent said cutting edges; and E. assembling said blade members with their cutting edges opposed and with a pivot member extending through said pivot apertures to provide for relative pivotal movement between a closed position wherein the cutting edge of each blade portion overlies the side surface of the blade portion of the other blade member and an open position wherein said cutting edges are spaced apart, said blade portions of said blade members being inclined towards each other and relative to said pivot portion to provide wiping action at the point of intersection along substantially the entire length of said cutting edges, said reinforcing bosses projecting oppositely from each other, the curves of said cutting edges being mirror images and, in said open position of said shears, intersecting at a point spaced from said pivot member towards the outer end of said cutting edges, said cutting edges having a curve corresponding to the following formula:

$$x = \frac{1}{\sqrt{\frac{y^2}{x^2} + 1}} \epsilon \left( \frac{1}{\tan \frac{\theta_c}{2}} \times \tan^{-1} \frac{y}{x} \right) + \log_\epsilon x_1$$

wherein $\theta_c$ = the cutting angle defined by the tangents to the curvilinear cutting edges at the point of intersection thereof;

x = the distance in inches from the center of the pivot aperture along the imaginary line bisecting the cutting angle ($\theta_c$);

y = the distance in inches to the cutting edge along an imaginary line perpendicular to imaginary line for x;

$x_1$ = the distance in inches along the imaginary line for x to the point of initial intersection of the blade edges in the open position;

and wherein $x_1$ is within the range of 0.3–2.0;

$\theta_c$ is within the range of 12–30°; and $\epsilon$ is 2.71828.

8. The method in accordance with claim 7 wherein the cutting edges of said blade members are ground to provide a rake angle of 4–14°.

9. The method in accordance with claim 7 wherein $x_1$ = 0.4–0.8 and $\theta_c$ = 14–22°;

and wherein the cutting edges of said blade members are ground to provide a rake angle of 4–14°.

* * * * *

UNITED STATES PATENT AND TRADEMARK OFFICE

CERTIFICATE OF CORRECTION

PATENT NO. : 4,150,484

DATED : April 24, 1979

INVENTOR(S) : William J. Hildebrandt

It is certified that error appears in the above-identified patent and that said Letters Patent are hereby corrected as shown below:

Column 2, lines 40-44;
Column 6, lines 23-28;
Column 9, lines 38-42;
Column 10, lines 34-38; in each instance the formula should read:

$$x = \frac{1}{\sqrt{\frac{y^2}{x^2} + 1}} \cdot \varepsilon^{\left(\frac{1}{\tan\left(\frac{\theta_c}{2}\right)} \cdot \tan^{-1} \frac{y}{x}\right) + \log_\varepsilon x_1}$$

Column 6, lines 56-57, the formula should read:

$$x_c = \sqrt{x_2^2 + y_2^2} - 1$$

Signed and Sealed this

Sixteenth Day of October 1979

[SEAL]

Attest:

RUTH C. MASON
Attesting Officer

LUTRELLE F. PARKER
Acting Commissioner of Patents and Trademarks